US005577065A

United States Patent [19]

Sales

[11] Patent Number: 5,577,065

[45] Date of Patent: Nov. 19, 1996

[54] DEVICE FOR MOUNTING A SELF-BAKING ELECTRODE FOR AN ELECTRIC ARC FURNACE

[75] Inventor: Maurice Sales, Annecy le Vieux, France

[73] Assignee: Pechiney Electrometallurgie, France

[21] Appl. No.: 514,735

[22] Filed: Aug. 14, 1995

[30] Foreign Application Priority Data

Sep. 5, 1994 [FR] France ..... 94 10774

[51] Int. Cl.[6] ..... H05B 7/09

[52] U.S. Cl. ..... 373/89; 373/91; 373/92; 373/97

[58] Field of Search ..... 373/88, 89, 90, 373/91, 92, 94, 97, 98, 99, 100

[56] References Cited

U.S. PATENT DOCUMENTS

| | | | |
|---|---|---|---|
| 1,579,824 | 4/1926 | Laurell | 373/92 |
| 3,524,004 | 8/1970 | Nostran et al. | 373/97 |
| 3,819,841 | 6/1974 | Persson | 373/97 |
| 4,349,910 | 9/1982 | Belz | 373/91 |
| 4,575,856 | 3/1986 | Persson | 373/89 |
| 4,629,280 | 12/1986 | Semmler et al. | 373/92 |
| 4,725,161 | 2/1988 | Dagata | 403/267 |
| 4,736,384 | 4/1988 | Sakai et al. | 373/92 |
| 5,351,266 | 9/1994 | Bullon Camarasa et al. | 373/89 |

FOREIGN PATENT DOCUMENTS

| | | |
|---|---|---|
| 488778 | 11/1918 | France . |
| 606568 | 6/1960 | Italy . |

OTHER PUBLICATIONS

G. Sem, The conception and birth of the Söderberg Electrode, Söderberg Electrode 75 Year Anniversary Seminar, Kristiansand, 1994, pp. 1–14.

*Primary Examiner*—Tu Hoang
*Attorney, Agent, or Firm*—Pollock, Vande Sande & Priddy

[57] ABSTRACT

A device for mounting a self-baking composite electrode for an electric arc furnace, which includes a hollow metallic shell, a central column of graphite or pre-baked carbon comprising a plurality of elements fitted together by means of nipples. A carbonaceous paste is disposed between the shell and the column. The column is suspended from a support which is movable in a vertical direction with respect to the shell, along a length which is greater than the length of each of the elements. The invention is particularly relevant to furnaces for the production of silicon by carbothermic means.

8 Claims, 2 Drawing Sheets

DEVICE FOR MOUNTING A SELF-BAKING ELECTRODE FOR AN ELECTRIC ARC FURNACE

FIELD OF THE INVENTION

The invention relates to the field of electrodes for electric arc furnaces and, more specifically, self-baking electrodes, known as Söderberg electrodes, for carbothermic reduction furnaces, such as furnaces for the production of metallurgical silicon.

DESCRIPTION OF RELATED ART

The principle of self-baking electrodes, which consists of inserting a crude carbonaceous paste into the furnace inside a cylindrical ferrule and baking this paste continuously during its utilization in the furnace, is known from a patent filed in 1917 by C. W. Söderberg, G. Sem, and J. Westly on behalf of the company Der Norske Aktielselkap for Elektrokemisk Industri, which corresponds to French Patent 488,778.

This technique, which is widely used today, leads to the production of continuous electrodes which, without preventive measures, contain about 2.5% iron, which originates in the steel ferrule.

In order to produce continuous electrodes with a lower iron content, several solutions have been proposed, all of which involve mechanically separating the electrode from its ferrule, so that it is possible to slide the electrode without also extending the ferrule. In this case, instead of the ferrule being equipped with internal ribs for supporting the electrode which was provided in the initial device, a smooth ferrule without ribs is used. This disposition, moreover, has been tested by Elektrokemisk since 1917 (cf. Söderberg Electrode 75 Year Anniversary Seminar, Kristiansand, Jun. 6–8, 1994, G. Sem, "The conception and birth of the S öderberg Electrode.")

Since the elimination of the ribs no longer allows the weight of the electrode to be supported by means of its ferrule, it is necessary to resort to a mounting arrangement which is different from the standard Söderberg arrangement and which involves supporting the weight of the electrode by means of a piece enclosed by the baked paste, a piece which is consumed at the same time as the electrode itself.

In Italian patent No. 606,568, filed in 1959 by the Edison company, this piece is a strip of perforated steel.

In U.S. Pat. No. 4,575,856 to J. A. Persson, granted Mar. 11, 1986, this support piece is a column which forms a pre-baked carbon or graphite electrode, constituted by elements fitted together by means of nipples, that is, fittings with double tapered screw threads, made of the same material, and screwed into the elements to be fitted together. French Patent No. 2,683,421, filed by the Spanish company Carburos Metallicos, claims various adaptations of this technique.

The arrangement proposed in these last two patents has a certain number of drawbacks.

On one hand, the mechanical load which is necessary to compensate for the weight of the electrode is transmitted to the column by a system of chucks. This load can reach substantial values, on the order of 50,000 to 75,000N. It is necessary, therefore, to exert considerable clamping pressure on the chuck, since the coefficient of friction between carbon and steel is low. In operation, this type of mounting arrangement causes wear on the surface of the graphite column, which increases the risk of rupture due to the tensile stress to which it is subjected. This rupture can have serious consequences for the electrode itself as well as for the furnace in which it is mounted.

On the other hand, the positioning of the chucks which clamp onto the column does not allow displacements of large amplitude. It is therefore necessary to reposition the chucks on the column frequently as the electrode is consumed, which contributes to increasing the damage caused to the column by the chucks.

SUMMARY OF THE INVENTION

The object of the invention is a device for mounting a self-baking electrode, equipped with a cylindrical metallic ferrule and a central column of graphite or pre-baked carbon constituted by elements fitted together by nipples, that does not have the disadvantages mentioned above.

According to the invention, the central column is suspended from a support which is movable in the vertical direction with respect to the ferrule along a length which is greater than the length of the elements. The displacement of the support can be obtained by means of screw jacks. The column can be fastened to the movable support by means of a threaded piece which is integral with the support and whose threading is identical to that of the nipples for fitting the elements of the column together.

BRIEF DESCRIPTION OF THE DRAWINGS

One particular embodiment of the invention will be described with the aid of drawing FIG. 1, which represents an axial cutaway view of a composite electrode and its mounting device.

DESCRIPTION OF THE PREFERRED EMBODIMENT

Figure 1:
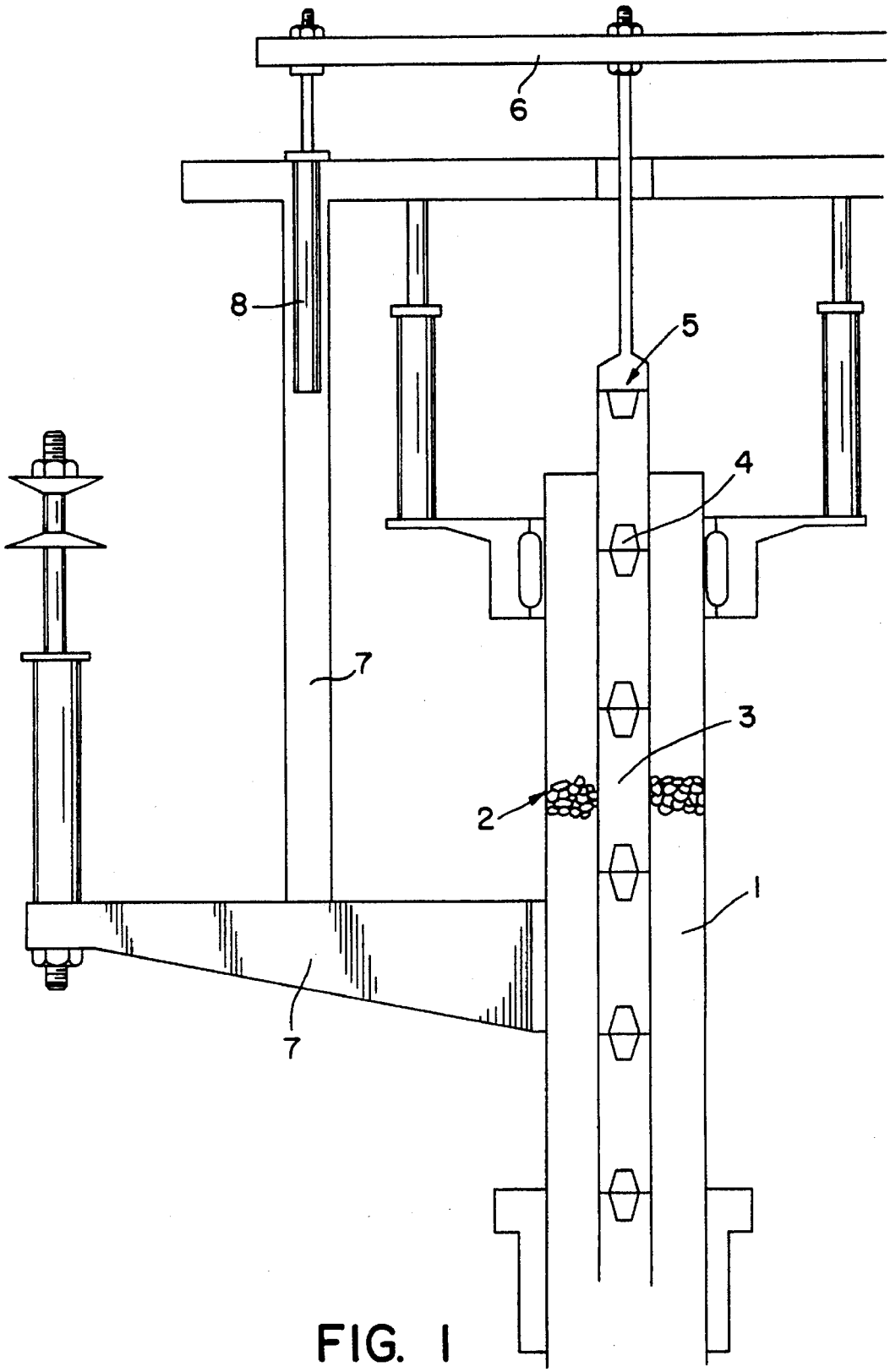
Figure 2:
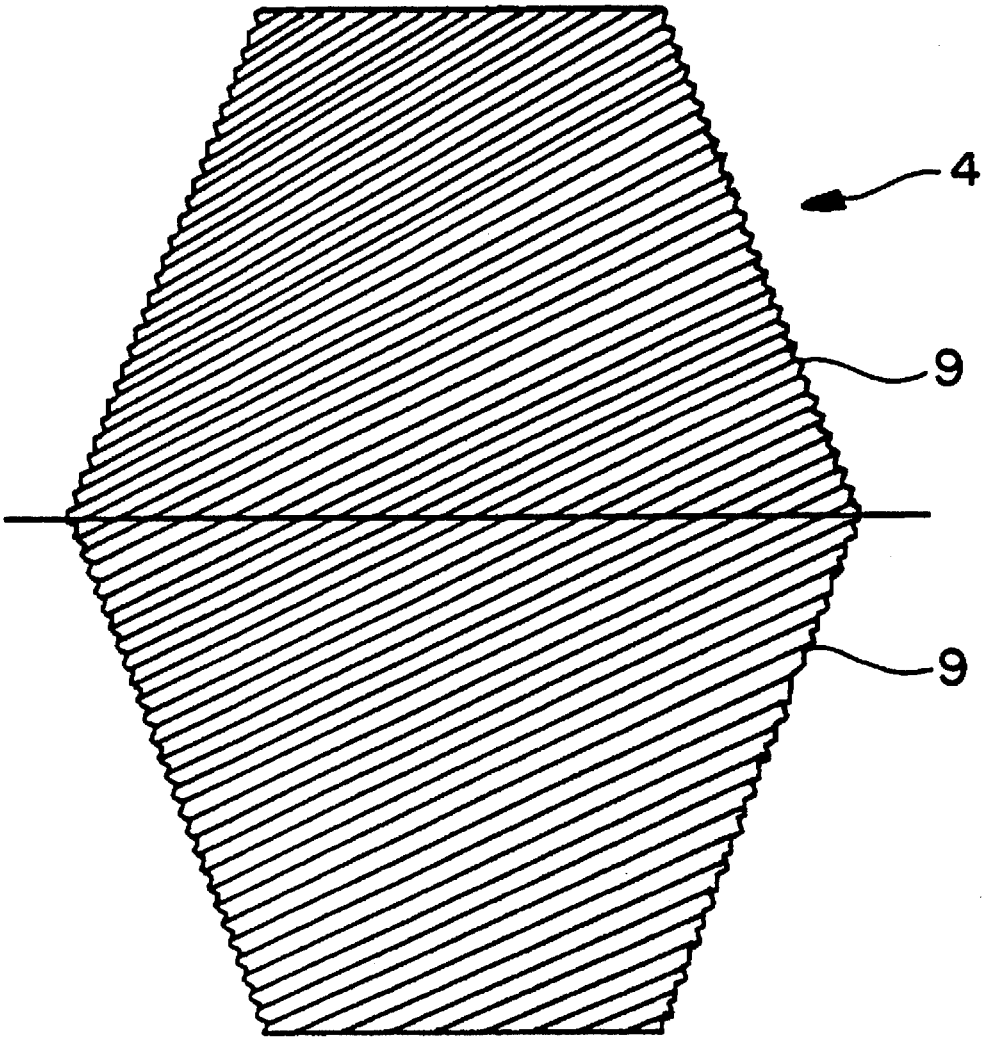
FIG. 2 is a schematic diagram of nipples 4 having external threads.

As shown in the drawing figure, a composite electrode 1 is constituted by a cylindrical metallic ferrule 2, in the form of a hollow cylindrical shell, which serves to contain carbonaceous paste inserted at its top end, which will bake progressively as it descends into the furnace. A cylindrical central column 3, with the same axis as the ferrule, is constituted by identical elements of pre-baked carbon or graphite, equipped at their two ends with tapered threaded holes and fitted to one another by means of nipples 4. The column 3 is held at its top end by a metallic piece 5 which has at its ends the same threading as the nipples 4. Nipples 4 can have external threads 9 as shown in FIG. 2. The piece 5 is directly screwed into the topmost element of column 3. This piece 5 is supported by a frame 6 whose relative position with respect to ferrule 2 and to a base 7 with which it is integral, is adjusted by two screw jacks 8 whose travel is greater than the length of the elements which form the column 3.

This mounting arrangement makes it possible to slide the electrode 1 along a length which is greater than or equal to the length of one element of the column 3 without having to re-attach the fastening between the column 3 and the piece 5. The travel of the screw jacks 8 is sufficient to allow the length of the column 3 to be extended by one element by performing only one take-up operation on the column 3. Thus, the surface of the carbon or graphite elements is not damaged by any clamping system and the tensile strength of the column 3 is retained in full.

Example

In a 20 MW furnace for the production of metallurgical silicon, originally equipped with pre-baked electrodes 1250 mm in diameter, a mounting device according to the invention was mounted, on a trial basis, on one of the electrodes. The column 3 is constituted by a plurality of elements with a length of 1700 mm for each element and a diameter of 450 mm, fitted together by nipples 4.

The topmost element of column 3 is fastened to a steel piece 5 which ends in a shape identical to that of a nipple 4. An apparatus for moving the electrode is constituted by a chassis 6 which supports the piece 5, and screw jacks 8 which make it possible to support the electrode and move the electrode along a length of 1850 mm solely by acting upon the volume of oil injected into the screw jacks.

This mounting arrangement made it possible to verify that the surface of the elements constituting the column 3 remained intact and that the operation could be carried out without difficulty, despite the exertion of a tensile stress of 75,000N on the column 3, a stress measured by means of the oil pressure on the screw jacks 8.

What is claimed is:

1. An apparatus for mounting a self-baking composite electrode for an electric arc furnace, comprising a generally cylindrical hollow metallic shell having a generally vertical central axis, a central column of a member selected from the group consisting of graphite and pre-baked carbon disposed along said axis and comprising a plurality of individual members selected from the group consisting of carbon and graphite elements of predetermined length secured together by nipples, said central column and said hollow metallic shell defining therebetween a space for carbonaceous paste, a support means from which the column is suspended, and means for moving said support means in a vertical direction with respect to the hollow metallic shell along a length which is greater than the length of each of the elements.

2. The apparatus according to claim 1, wherein the means for moving said support means comprises screw jacks.

3. The apparatus of claim 1, wherein said nipples are externally threaded.

4. The apparatus according to of claim 1, wherein column is suspended from the support means by an externally threaded piece having threading identical to that of the nipples.

5. The apparatus of claim 2, wherein said nipples are externally threaded.

6. The apparatus according to claim 5, wherein said column is suspended from the support means by an externally threaded piece having threading identical to that of the nipples.

7. The apparatus according to claim 2, wherein said column is suspended from the support means by an externally threaded piece having threading identical to that of the nipples.

8. The apparatus according to claim 3, wherein said column is suspended from the support means by an externally threaded piece having threading identical to that of the nipples.

* * * * *